US008099920B2

(12) United States Patent
Ito et al.

(10) Patent No.: US 8,099,920 B2
(45) Date of Patent: Jan. 24, 2012

(54) EXTERNAL WALL CONSTRUCTING STRUCTURE

(75) Inventors: Tsuneaki Ito, Kuwana (JP); Koji Sawada, Anjo (JP); Shin Takami, Nagoya (JP)

(73) Assignee: Nichiha Corporation, Nagoya-Shi (JP)

( * ) Notice: Subject to any disclaimer, the term of this patent is extended or adjusted under 35 U.S.C. 154(b) by 737 days.

(21) Appl. No.: 12/219,941

(22) Filed: Jul. 30, 2008

(65) Prior Publication Data

US 2009/0084052 A1 Apr. 2, 2009

(30) Foreign Application Priority Data

Sep. 29, 2007 (JP) ..... 2007-256994

(51) Int. Cl.
*E04B 2/00* (2006.01)

(52) U.S. Cl. ..... 52/367; 52/239; 52/243.1

(58) Field of Classification Search ..... 52/367, 52/236.9, 239, 243, 243.1, 235
See application file for complete search history.

(56) References Cited

U.S. PATENT DOCUMENTS 6,598,362 B2 * 7/2003 Hikai ..... 52/235

FOREIGN PATENT DOCUMENTS

JP 2006-207221 A 8/2006

* cited by examiner

*Primary Examiner* — Basil Katcheves

(74) *Attorney, Agent, or Firm* — Birch, Stewart, Kolasch & Birch, LLP

(57) ABSTRACT

An external wall constructing structure excellent in ornamental appearance, weather resistance, contractibility, and safety is provided. An external wall constructing structure 1 comprising external wall panels that are joined to each other by vertical and horizontal shiplap joints and secured to a skeleton of a building by securing a metal fitting 5. A cut-off end portion 23 of a dimension-adjusted external wall panel 20 among the plurality of external wall panels is fixed to a skeleton 10 of the building via end constructing bracket 3. Left and right joint end portions of the dimension-adjusted external wall panel 20 are fixed to the skeleton 10 via lateral end securing metal fittings 6. In the end constructing bracket 3, a rear plate portion 31 is abutted on rear surface 26 of the dimension-adjusted external wall panel 20 and forward-bending portion 32 is abutted on cut-off end surface 231 of the dimension-adjusted external wall panel 20. The rear plate portion 31 and the rear surface 26 of the dimension-adjusted external wall panel 20 are adhered by adhesive agent 11. The forward-bending portion 32 of the end constructing bracket 3 has horizontal section 320, front section 321 and third abutting section 322 and sealing material 163 is placed in front of the front section 321.

5 Claims, 9 Drawing Sheets

EXTERNAL WALL CONSTRUCTING STRUCTURE

FIELD OF THE INVENTION

This invention relates to an external wall constructing structure where a plurality of external wall panel are joined to each other by vertical and horizontal shiplap joints, and are secured to a skeleton of a building by a securing metal fitting.

DESCRIPTION OF THE RELATED ARTS

A securing metal fitting is generally used for external wall panel construction. The external wall panel is fixed to a skeleton by a securing a metal fitting via a furring strip. When an external wall panel is placed above an opening (e.g., window), some part of the panel is cut off to adjust the dimension of the panel so as to fit the shape of the opening. This makes it impossible to use a securing metal fitting for securing the panel. Therefore a part of the external wall panel located above an opening is secured to the skeleton using a nail after placing a spacer between the external wall panel and a furring strip.

JP 2006-207221A discloses an external wall constructing structure where a cut-off end portion of a dimension-adjusted external wall panel is fixed to a skeleton via an end constructing bracket. As shown in FIG. 9, an external wall panel 92 is placed above a sash 961 of an opening 96 after being cut off to form a dimension-adjusted external wall panel 920. A cut-off end 921 of the dimension-adjusted external wall panel 920 is fixed to a furring strip 95 by an adhesive agent 91 via an end constructing bracket 93. A forward-bending portion 932 of the end constructing bracket 93 is abutted on the cut-off end 921. The furring strip 95 is fixed to the skeleton 90. A sealing material 963 is applied to a joint portion between the sash 961 and the dimension-adjusted external wall panel 920, and a back-up (backing) material 964 is disposed behind the sealing material 963.

With respect to the above-mentioned external wall constructing structure where a nail is used for fixing the panel, ornamental appearance in a region of the dimension-adjusted external wall panel becomes poor. This is because the other parts of external wall where the panel can be fixed by using a securing metal fitting have an excellent ornamental appearance. However, the limited part mentioned above has to use a nail because of difficulty of using securing metal fittings therewith.

Also a part where the nail is driven has to be coated with a refinish paint to improve the ornamental appearance which lowers construction efficiency and raises construction cost. Further, driving a nail may cause cracks or chippings and/or water leakage.

Particularly when an external wall panel made of a hard material such as a calcined base material is used; driving a nail can easily make a crack, which causes damage of the external wall panel.

Problems mentioned above can occur not only at the location above the opening but also below the opening, at a tie-in part with a lower roof or at an overhang part and at any other construction place where a dimension-adjusted external wall panel (partially cut-off) is used.

Further, as disclosed in JP 2006-207221, in the case of applying a sealing material between a sash and a dimension-adjusted external panel, a back-up (backing) material also has to be prepared and disposed in advance behind the place where the sealing material is supposed to be placed. This lowers construction efficiency.

Furthermore, the external wall panel is not fixed completely until an adhesive agent is dried and solidified. This may cause the external wall panel to move forward to create an unevenness, which leads to a poor ornamental appearance. Also, even after the adhesive agent is completely solidified, the external wall panel can still fall away (or fall off) because of degradation of an adhesive agent, earthquake and/or traffic vibration (i.e., there is safety problem).

SUMMARY OF THE INVENTION

This invention is made to solve the above-mentioned problems and to provide an external wall constructing structure that is excellent in ornamental appearance, weather resistance, constructability, and safety.

In a first aspect of the present invention, there is provided an external wall constructing structure comprising a plurality of external wall panels that are joined to each other by vertical and horizontal shiplap joints and secured to a skeleton of a building by a securing metal fitting, wherein:

the plurality of external wall panels include a dimension-adjusted external wall panel having a cut-off end portion formed to adjust a vertical width of the panel, the dimension-adjusted external wall panel is fixed to the skeleton of the building by an end constructing bracket engaged to the cut-off end portion, and by a lateral end securing metal fitting engaged to one of end portions selected from left and right joint end portions; and the end constructing bracket comprises a rear plate portion to be fixed to the skeleton and a forward-bending portion extending forward from one end of the rear plate portion.

In a second aspect of the present invention, in an external wall constructing structure, the rear plate portion of the end constructing bracket comprises a first abutting section to be abutted on the skeleton in one end area of the end constructing bracket that is adjacent to the forward-bending portion, a second abutting section to be abutted on the skeleton in the other end area of the end constructing bracket, and a panel-rear-surface abutting section raised forward between the first abutting section and the second abutting section of the end constructing bracket to be abutted on the rear surface of the dimension-adjusted external wall panel, wherein the forward-bending portion of the end constructing bracket comprises a horizontal section abutted on a cut-off end surface of the dimension-adjusted external wall panel, and a front section downwardly extending from one end of the horizontal section.

In a third aspect of the present invention, in an external wall constructing structure, the forward-bending portion of the end constructing bracket further comprises a third abutting section further extending horizontally and backwardly from one end of the front section to abut on the skeleton.

In a fourth aspect of the present invention, in an external wall constructing structure, the lateral end securing metal fitting comprises:

a base plate section with a screw hole for fixing the metal fitting to the skeleton, a bottom section bending upward from the base plate section so as to be perpendicular to the base plate section; a folding back section bending backward from the bottom section in a direction that is roughly parallel to the base plate section, a receiving section formed by bending an end part of the folding back section upward in a direction that is roughly perpendicular to the base plate section, a holding section 65 formed by bending an end part of the receiving section forward in a direction that is roughly parallel to the base plate section, and a rear-surface abutting section formed by cutting and bending upwards a part from the bottom section to the folding back section, so that a surface of the rear-surface abutting section is roughly parallel to the base plate section and abuts a rear surface of the dimension-adjusted external wall panel; and wherein the holding section holds the dimension-adjusted external wall panel at either one of a left or right joint portion of the dimension-adjusted external wall panel, and a surface of the rear-surface abutting section abuts the rear surface of the dimension-adjusted external wall panel.

In a fifth aspect of the present invention, an external wall constructing structure further comprises a sealing material placed in front of a front section of the forward-bending portion of the end constructing bracket.

In a sixth aspect of the present invention, in an external wall constructing structure, the external wall panel is a ceramic type external wall panel made of a calcined base material.

In the above-described external wall constructing structure, the cut-off end of the dimension-adjusted external wall panel is fixed to the skeleton by using the end constructing bracket. Therefore there is no need to use a nail to fix the cut-off end portion. That is, the nail head does not exist on the surface of the external wall panel. Consequently, an excellent ornamental appearance can remain unchanged. In other words, external wall panels including the dimension-adjusted external wall panel can be constructed (fixed) by using metal fittings so as to keep an excellent ornamental appearance. As such here is no need of coating or refinish painting. This improves construction efficiency and lowers construction cost. Further, it is not likely to provide damage to an external wall panel or to provide water leakage. Thus, the external wall panel can be provided with excellent weather resistance. Furthermore, there is no need to place a back-up (backing) material in the back of joint portion before applying a sealing material since the end constructing bracket functions as the back-up material. In addition, the dimension-adjusted external wall panel is fixed by securing one of the end portions of the left and right shiplap joint portions by using a lateral securing metal fitting. This can reduce the formation of unevenness of the external wall panel and prevent the dimension-adjusted external wall panel from falling away (or falling off). Thus, according to this invention, an external wall constructing structure, which is excellent in ornamental appearance, weather resistance, constructability and safety, can be obtained.

The present invention also separately provides for each of end constructing brackets and lateral end securing metal fittings that are useful in the external wall constructing structure of the instant invention.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Preferable embodiments of the present invention are described with reference to the FIGS. 1-8.

FIG. 1, FIG. 2 FIG. 3 FIG. 6 and FIG. 7 show parts of an external wall constructing structure of the invention. FIG. 4 shows an example of an end constructing bracket used for an external wall constructing structure of the invention. FIG. 5 shows an example of a lateral end securing metal fitting used for an external wall constructing structure of the invention. FIG. 8 shows examples of modified end constructing bracket used for an external wall constructing structure of the invention.

In this specification, "front" denotes "outer side of building", "rear" denotes "inner side of building". In connection with an external wall constructing structure, "front", "rear", "up/upper/top", "down/lower/bottom", "horizontal" or "vertical" are used in the situation where the external wall constructing structure are being fixed to a skeleton.

Example 1

Figure 2:
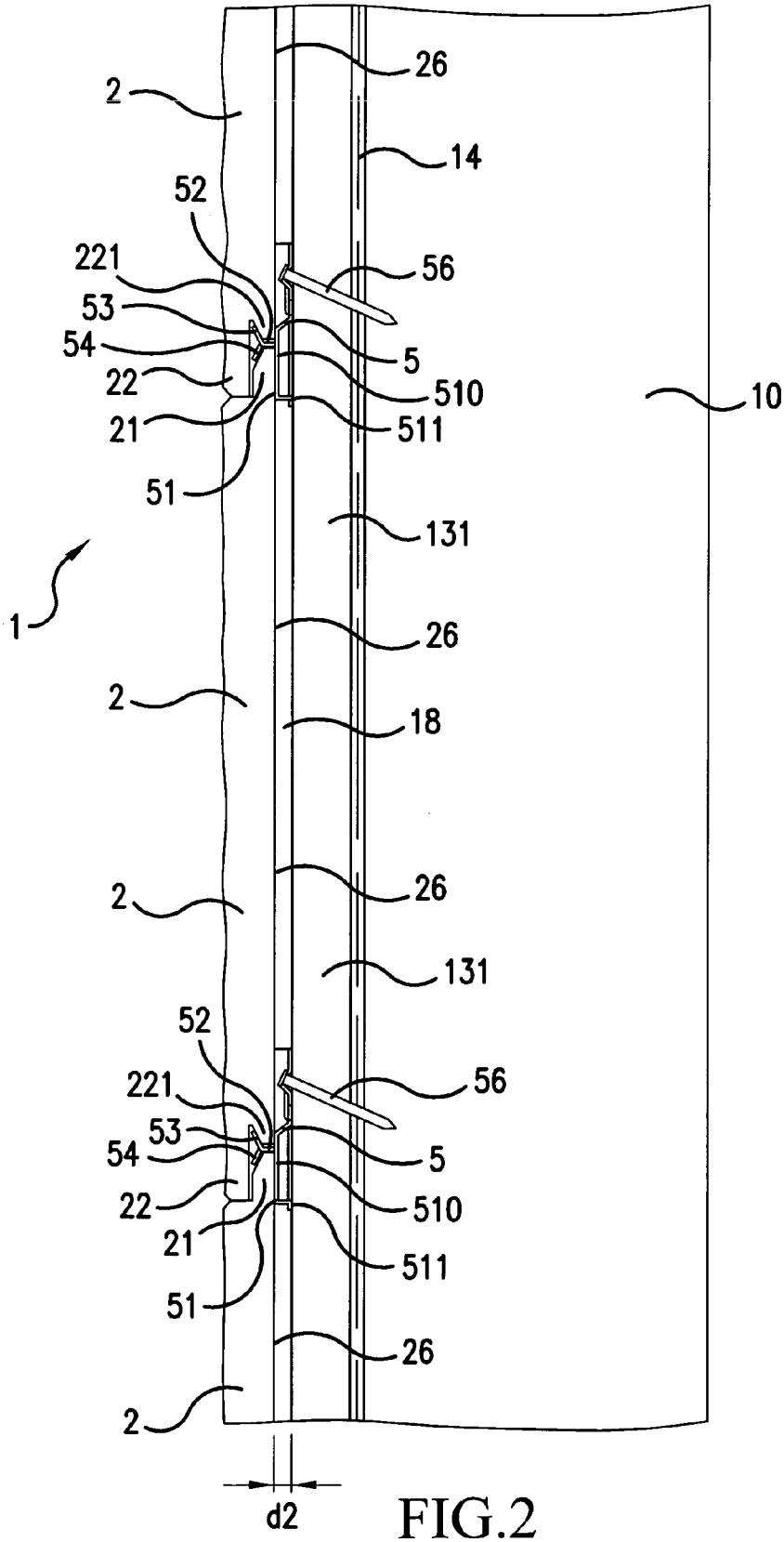
FIG. 2 is a vertical cross-sectional view showing external wall panel being secured.

As shown in FIG. 2, a plurality of external wall panels 2 is vertically shiplapped with each other in an external wall constructing structure 1 of the example. The external wall panel 2 is fixed to a skeleton 10 of the building by using a securing metal fitting 5. A lower tongue portion 21 is formed on the top of a lower (downside-disposed) external wall panel 2. An upper tongue portion 22 is formed on the bottom of an upper (upside-disposed) external wall panel 2. A securing metal fitting 5 is fixed to the skeleton 10 while securing both the lower tongue portion 21 and the upper tongue portion 22

Figure 1:
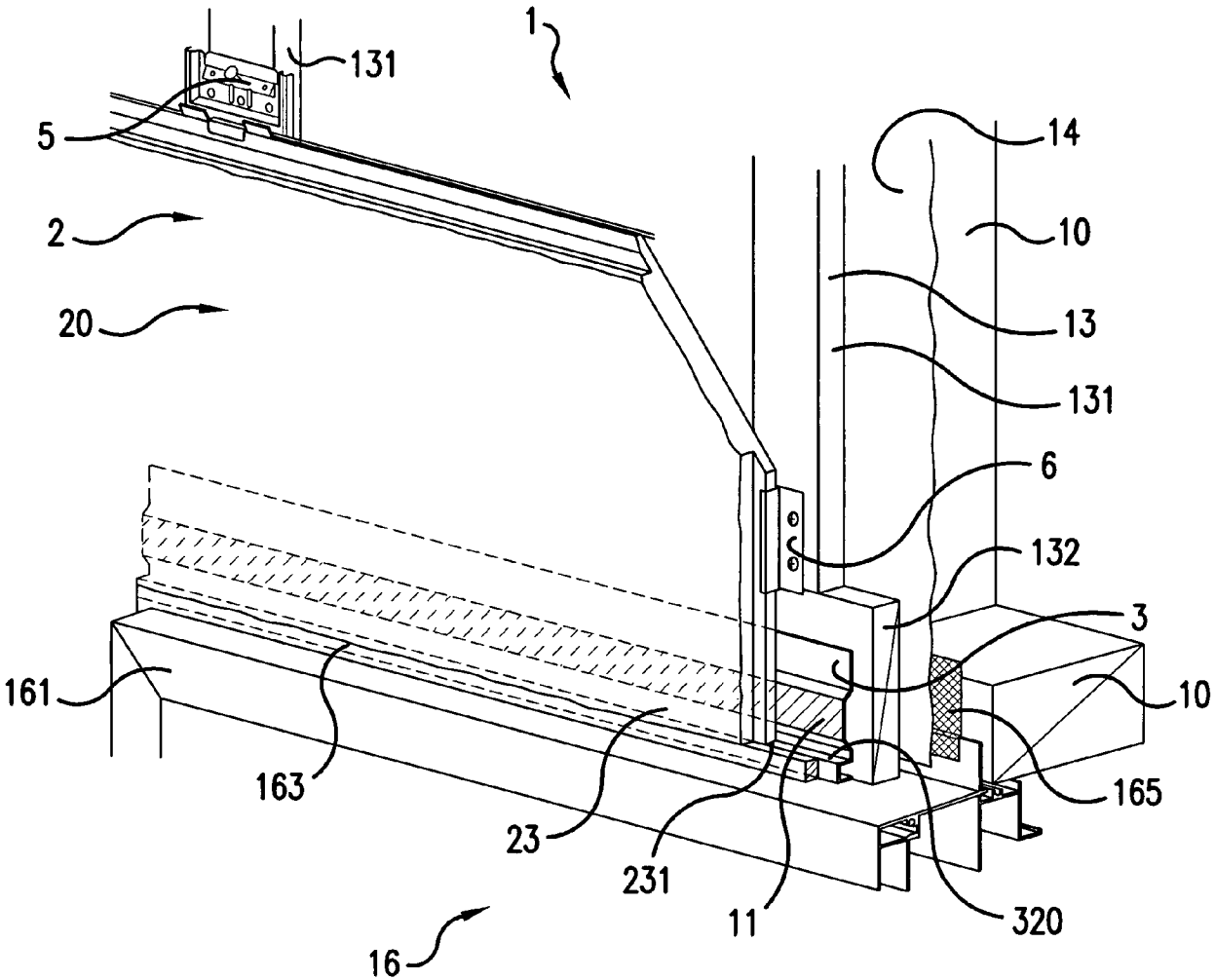
FIG. 1 is a perspective view showing an external wall constructing structure of Example 1 of the invention.
Figure 3:
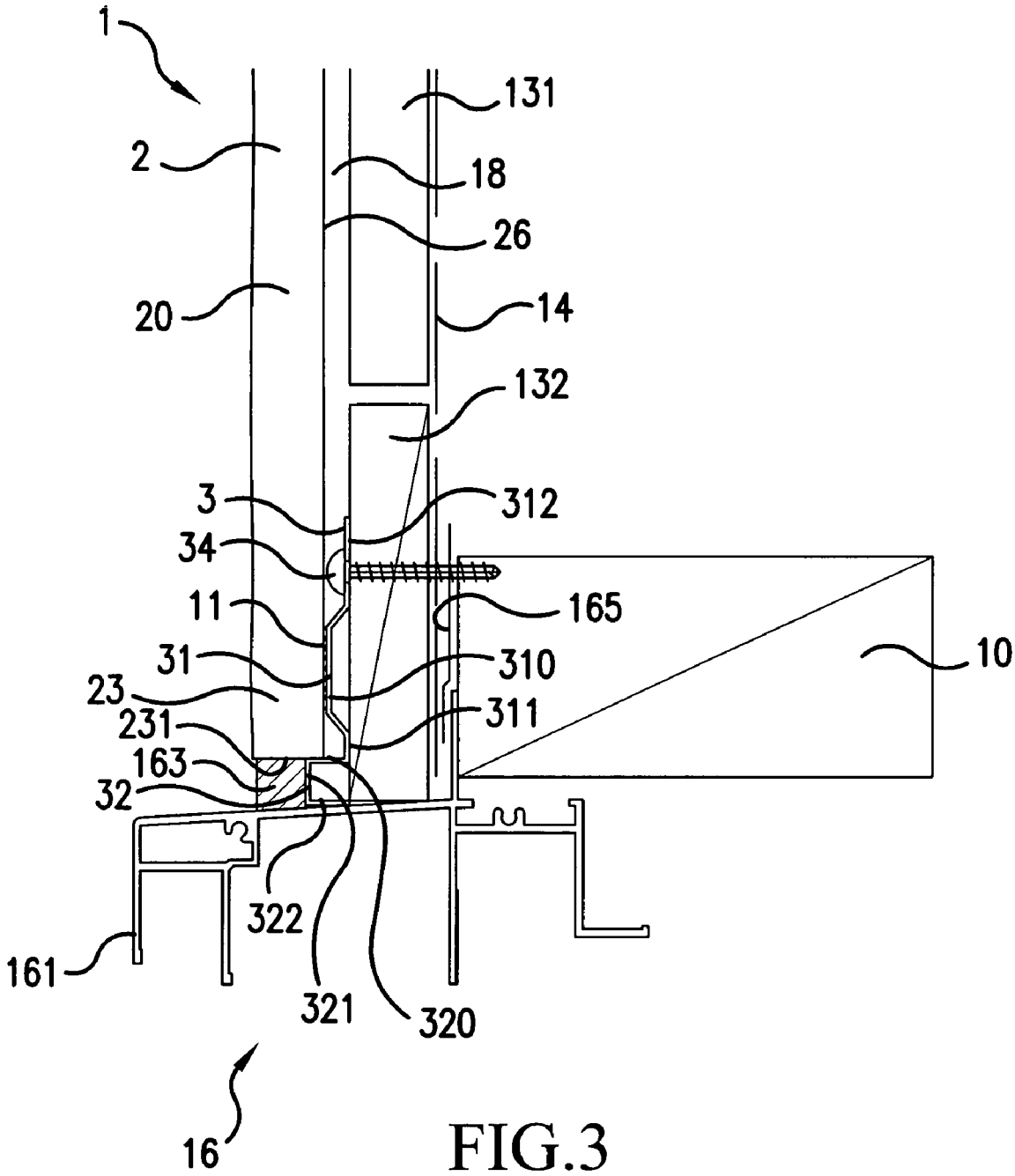
FIG. 3 is a vertical cross-sectional view showing an external wall constructing structure of Example 1 of the invention.
Figure 4A:
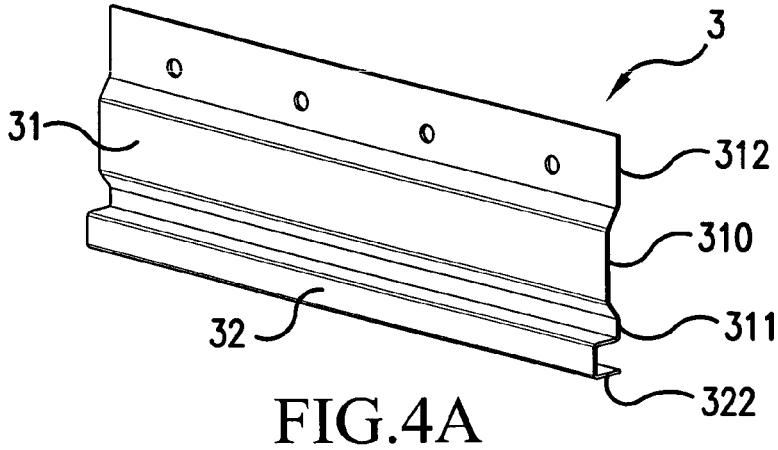
FIG. 4A is a perspective view showing an end constructing bracket which is a part of an external wall constructing structure of the invention.
Figure 4B:
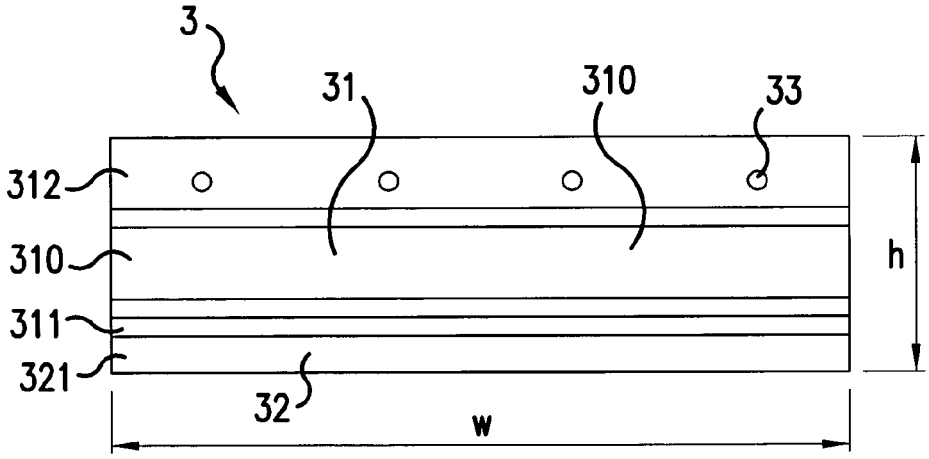
FIG. 4B is a front elevational view showing an end constructing bracket which is a part of an external wall constructing structure of the invention.
Figure 4C:
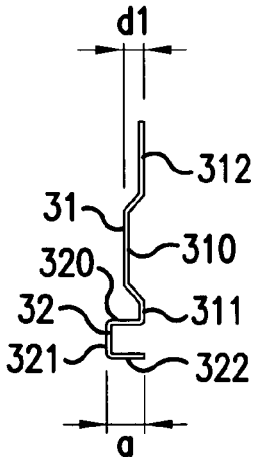
FIG. 4C is a right-side elevational view showing an end constructing bracket which is a part of an external wall constructing structure of the invention.

As shown in FIG. 1 and FIG. 3, among the plurality of external wall panels (e.g., ceramic type siding) 2, a dimension-adjusted external wall panel 20 disposed above the opening is cut off to remove the bottom part to adjust the vertical width. That is, the dimension-adjusted external wall panel 20 has a cut-off end portion 23 in place of an upper tongue portion 22. Consequently the bottom of the dimension-adjusted external wall panel 20 can not be fixed to the skeleton by using a securing metal fitting 5. In order to fix the cut-off end portion 23 to the skeleton 10, an end constructing bracket 3 is used.

As shown in FIG. 4, the end constructing bracket 3 has a rear plate portion 31 to be fixed to the skeleton 10 and a forward-bending portion 32 extending forward from one end of the rear plate portion 31. The rear plate portion 31 has a first abutting section 311 in one end area adjacent to the forward-bending portion 32, a second abutting section 312 in the other end area and a panel-rear-surface abutting section 310 raised forward between the first abutting section 311 and the second abutting section 312. Each of the first abutting section 311 and the second abutting section 312 is to be abutted on the skeleton 10 and the panel-rear-surface abutting section 310 is to be abutted on the rear surface of the dimension-adjusted external wall panel. The forward-bending portion 32 has a horizontal section 320, a front section 321 downwardly extending from one end of the horizontal section 320 and a third abutting section 322 further extending horizontally and backwardly from one end of the front section to abut on the skeleton.

As shown in FIG. 3, the end constructing bracket 3 supports the dimension-adjusted external wall panel 20 by making the horizontal section 320 of the forward-bending portion 32 abut on a cut-off end surface 231 of the dimension-adjusted external wall panel 20 while making a panel-rear-surface abutting section 310 of the rear plate portion 31 abut on a rear surface 26 of the dimension-adjusted external wall panel 20.

An adhesive agent 11 bonds the rear surface 26 of the dimension-adjusted external wall panel 20 and the panel-rear-surface abutting section 310 of the rear plate portion 31 together. If some amount of the adhesive agent 11 sticks out downward from the panel-rear-surface abutting section 310 because of excessive application amount of the adhesive agent 11, the stuck out adhesive can be trapped in the space formed with the forward-raised panel-rear-surface abutting section 310 and the first abutting section 311. Therefore, the stuck out adhesive does not influence adhesion between the cut-off end surface 231 and a sealing material 163 to be described later.

It is preferable that the adhesive agent 11 bonds only two parts, i.e., the panel-rear-surface abutting section 310 of the rear plate portion 31 and the rear surface 26 of the dimension-adjusted external wall panel 20, for reducing the material cost of adhesive agent 11. The panel-rear-surface abutting section 310 can have an opening therein to make the adhesive agent 11 stick out rearward so that the three parts of the panel-rear-surface abutting section 310, the rear surface 26 and a furring strip 13 can be bonded together by the adhesive agent. This makes it possible to fix the dimension-adjusted external wall panel 20 more firmly to the skeleton 10.

A sealing material 163 is disposed between the cut-off end portion 23 (cut-off end surface 231) and a sash 161. The front section 321 of the forward-bending portion 32 of the end constructing bracket 3 is located on the rear side of the sealing material 163. Because of this front section 321 of the forward-bending portion 32 of the end constructing bracket 3, width of the joint portion can be secured. A vertical width of the front section 321 is nearly the same as that of joint portion filled with the sealing material, which makes it possible to provide a constant width of the joint with sealing material, lead to improved construction efficiency.

As shown in FIG. 1, a right end portion of the dimension-adjusted external wall panel 20 is fixed by a lateral end securing metal fitting 6. More specifically the lateral end securing metal fitting 6 secures a shiplap joint portion formed on the right end portion of the dimension-adjusted external wall panel 20.

As shown in FIG. 5, the lateral end securing metal fitting 6 is a metal fitting with a roughly h-shaped cross section for securing an external wall panel having a shiplap portion on both left and right end portions thereof to the skeleton. The lateral end securing metal fitting 6 has a base plate section 61 to be fixed to the skeleton, a bottom section 62 bending upward so as to be perpendicular to the base plate section 61, a folding back section 63 bending backward in a direction that is roughly parallel to the base plate section 61, a receiving section 64 formed by bending an end part of the folding back section 63 upward again in a direction that is roughly perpendicular to the base plate 61, and a holding section 65 formed by bending an end part of the receiving section 64 forward in a direction that is roughly parallel to the base plate 61. Further a rear-surface abutting section 66 is formed by cutting and bending upward a part from the bottom section to the folding back section 63. A surface of the rear-surface abutting section 66 is roughly parallel to the base plate section and abuts on the rear surface of the external wall panel. The base plate portion 61 has a screw hole 67 and may have reinforcing rib thereon.

Figure 5A:
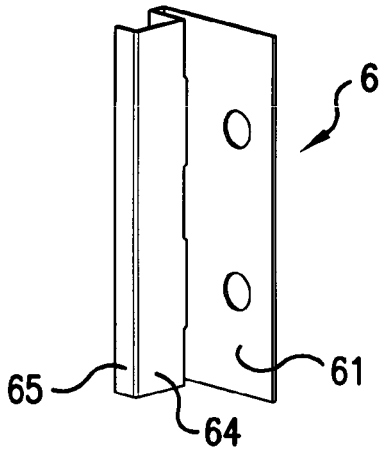
FIG. 5A is a perspective view showing a lateral end securing metal fitting which is a part of an external wall constructing structure of the invention.
Figure 5B:
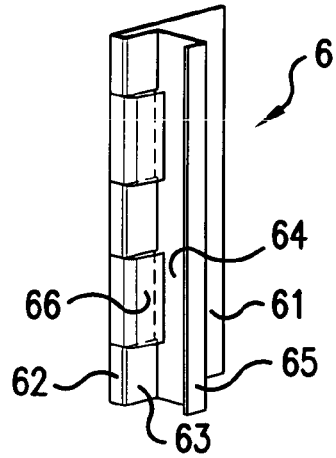
FIG. 5B is another perspective view showing a lateral end securing metal fitting which is a part of an external wall constructing structure of the invention.
Figure 5C:
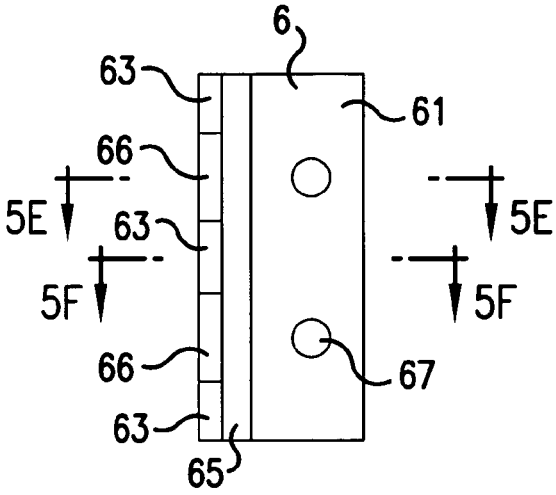
FIG. 5C is a front elevational view showing a lateral end securing metal fitting which is a part of an external wall constructing structure of the invention.
Figure 5E:
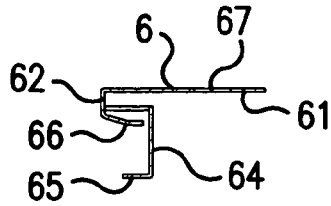
FIG. 5E is a cross sectional view taken along the line 5E-5E of FIG. 5C
Figure 5F:
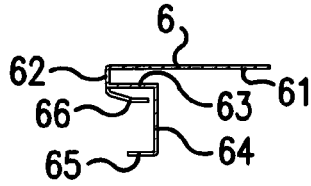
FIG. 5F is a cross sectional view taken along the line 5F-5F of FIG. 5C
Figure 5D:
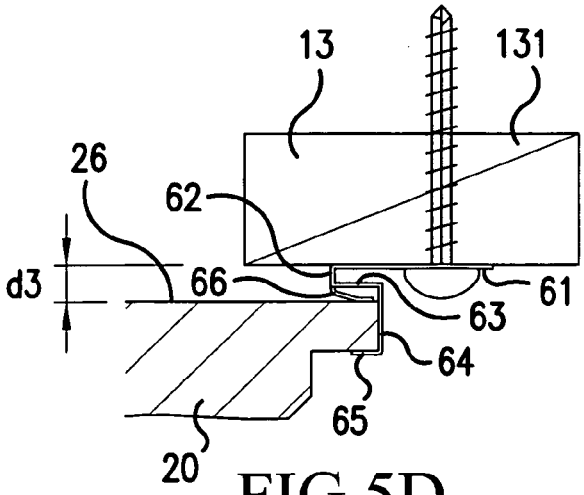
FIG. 5D is a top plan view showing a lateral end securing metal fitting, which is a part of an external wall constructing structure of the invention, with horizontal cross-sectional view of a dimension-adjusted external wall panel.

As shown in FIG. 5D, the dimension-adjusted external wall panel 20 is secured at the right end portion by the holding section 65 of the lateral end securing metal fitting 6. The rear-surface abutting section 66 is abutted on the rear surface 26 of the dimension-adjusted external wall panel 20. Here, a drawing of left side end joint of the dimension-adjusted external wall panel 20 is omitted.

As shown in FIG. 1, the securing metal fitting 5, the end constructing bracket 3 and the lateral end securing metal fitting 6 are fixed to the skeleton 10 via furring strips 13. A vertical furring strip 131 is fixed to the skeleton 10 and the securing metal fitting 5 and the lateral end securing metal fitting 6 are fixed to the vertical furring strip 131. A horizontal furring strip 132 is fixed to the skeleton 10 and the end constructing bracket 3 is fixed to the horizontal furring strip 132. The end constructing bracket 3 can directly be fixed to the vertical furring strip without having a horizontal furring strip.

As shown in FIG. 2, the securing metal fitting 5 has a base plate section 51 which is to be abutted on the rear surface 26 of the external wall panel 2 and fixed to the skeleton 10, a supporting section 52 bending forward from the base plate section 51, an upper panel holding section 53 extending obliquely upward from the supporting section 52, and a lower panel holding section 54 extending obliquely downward from the supporting section 52. A lower tongue portion 21 of the lower external wall panel 2 is secured by the lower panel holding section 54 of the securing metal fitting 5. An upper tongue portion 21 of the upper external wall panel 2 is secured by the upper panel holding section 53 of the securing metal fitting 5 while being supported by the supporting section 52. More specifically, the upper panel holding section 53 secures a rear stopping tongue 221 formed in the rear side of the upper tongue portion 22 of the external wall panel 2. The securing metal fitting 5 is fixed using fixing stuff such as nail 56 or screw to the vertical furring strip 131 which is fixed to the skeleton 10.

As shown in FIG. 2 and FIG. 4, a rear plate portion 31 of the end constructing bracket and a base plate section 51 of the securing metal fitting 5 are almost identical in front-rear direction width (depth). That is, a front-rear direction width d1 (FIG. 4) of the rear plate portion 31 is almost identical to a front-rear direction width d2 (FIG. 2) of the base plate portion 51. The width is for example about 5 mm. The base plate section 51 has a backing-member abutting section 511 which is to be abutted on the furring strip 13 of backing member and a panel-rear-surface abutting section 510 raised forward from the backing-member abutting section 511. The panel-rear-surface abutting section 510 is to be abutted on the rear surface 26 of the external wall panel 2.

The front-rear direction width d2 of the base plate 51 is defined as a distance in the front-rear direction between the backing-member abutting section 511 and the panel-rear-surface abutting section 510.

As shown in FIG. 3 and FIG. 4, the rear plate portion 31 of the end constructing bracket 3 has a first abutting section 311 in one end area adjacent to the forward-bending portion 32, a second abutting section 312 in the other end area and a panel-rear-surface abutting section 310 raised forward between the first abutting section 311 and the second abutting section 312.

Each of the first abutting section 311 and the second abutting section 312 is to be abutted on the skeleton 10 and the panel-rear-surface abutting section 310 is to be abutted on the rear surface 26 of the dimension-adjusted external wall panel 20. The front-rear direction width d1 of the rear plate portion 31 is defined as a distance in the front-rear direction between the first abutting section 311 or the second abutting section 312 and the panel-rear-surface abutting section 310.

A rear-surface abutting section 66 of the lateral end securing metal fitting 6 and the rear plate portion 31 of the end constructing bracket 3 have almost the same front-rear direction width. That is, the front-rear direction width d3 (FIG. 5D) of the rear-surface abutting section 66 is almost identical to the front-rear direction width d1 (FIG. 4) of the rear plate portion 31. The width is for example about 5 mm.

As a result, as shown in FIG. 2 and FIG. 3, a vent layer 18 is formed between the external wall panel 2 and the furring strip 13. Clearance of the vent layer 18 (e.g., 5 mm) is almost the same as d1 of width in front-rear direction of the rear plate portion 31 of the end constructing bracket 3, d2 of width in front-rear direction of the base plate section 51 of the securing metal fitting 5 or d3 of width in front-rear direction of the rear-surface abutting section 66 of the lateral end securing metal fitting 6.

The end constructing bracket 3 is formed by bending a plated steel plate of about 1 mm thickness. It is preferable to use the plate with 0.5 mm thickness or more to secure the strength. The end constructing bracket 3 can be a horizontally long shape, for example, 1836 mm in horizontal width (w) and 60 mm in vertical width (h). The front-rear direction width d1 of the rear plate portion 31 is about 5 mm. A horizontal section 320 of the forward-bending portion 32 can be 13 mm in length (a). Thus a cut-off end surface 231 of the dimension-adjusted external wall panel 20 can be supported by 8 mm width of the horizontal section 320. As shown in FIG. 4, in the end constructing bracket 3, the second abutting section 312 of the rear plate portion 31 has a plurality of screw holes 33 (5 mm in diameter) matching pillar interval. Although it is not shown, a tape (film) which functions as a bond breaker to prevent a sealing material from adhering to the front surface of a front section 321 of the end constructing bracket 3, can be applied to these faces.

The end constructing bracket 3 is fixed to the furring strip 13 secured to the skeleton 10 using a screw 34 put through the screw hole 33. As shown in FIG. 1 and FIG. 2, a moisture permeable waterproof sheet 14 is placed between the furring strip 13 and the skeleton 10. Also a waterproof tape 165 is applied from a sash 162 to the skeleton 10 to prevent rainwater from coming in.

Example 2

Figure 6:
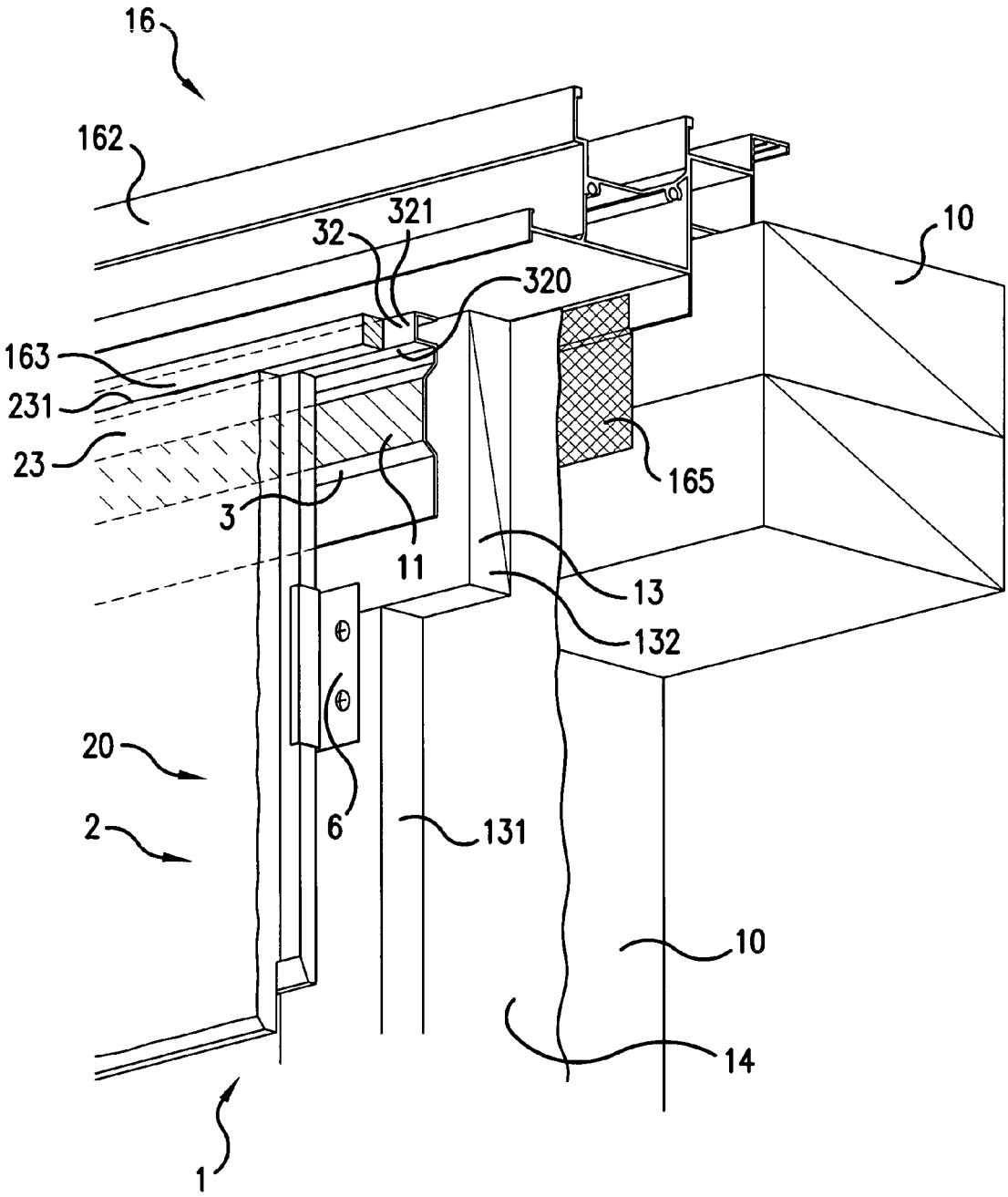
FIG. 6 is a perspective view showing an external wall constructing structure of example 2 of the invention.

FIG. 6 shows an example of external wall constructing structure 1 applied to a region below an opening 16 for window or the like where an end constructing bracket 3 is engaged to a cut-off end portion 23 of a dimension-adjusted external wall panel 20 disposed below the opening 16.

A sash 162 is disposed in the bottom of the opening 16. A horizontal furring strip 132 and the dimension-adjusted external wall panel 20 are arranged below the sash 162. The dimension-adjusted external wall panel 20 is cut off in the upper portion so as to fit the shape of the opening 16. A cut-off end portion 23 is disposed below the opening 16 and the end constructing bracket 3 is engaged to the cut-off end portion 23.

The end constructing bracket 3 is arranged so that a forward-bending portion 32 is top in position. A horizontal section 320 of the forward-bending portion 32 is abutted on a cut-off end surface 231 of the dimension-adjusted external wall panel 2. In other words, the end constructing bracket 3 is arranged upside down compared to example 1. A sealing material 163 is disposed between the cut-off end portion 23 and a sash 162. A front section 321 of a forward-bending portion 32 of the end constructing bracket 3 is located on the rear side of the sealing material 163. The example 2 is the same as example 1 except for the conditions described above.

Example 3

Figure 7:
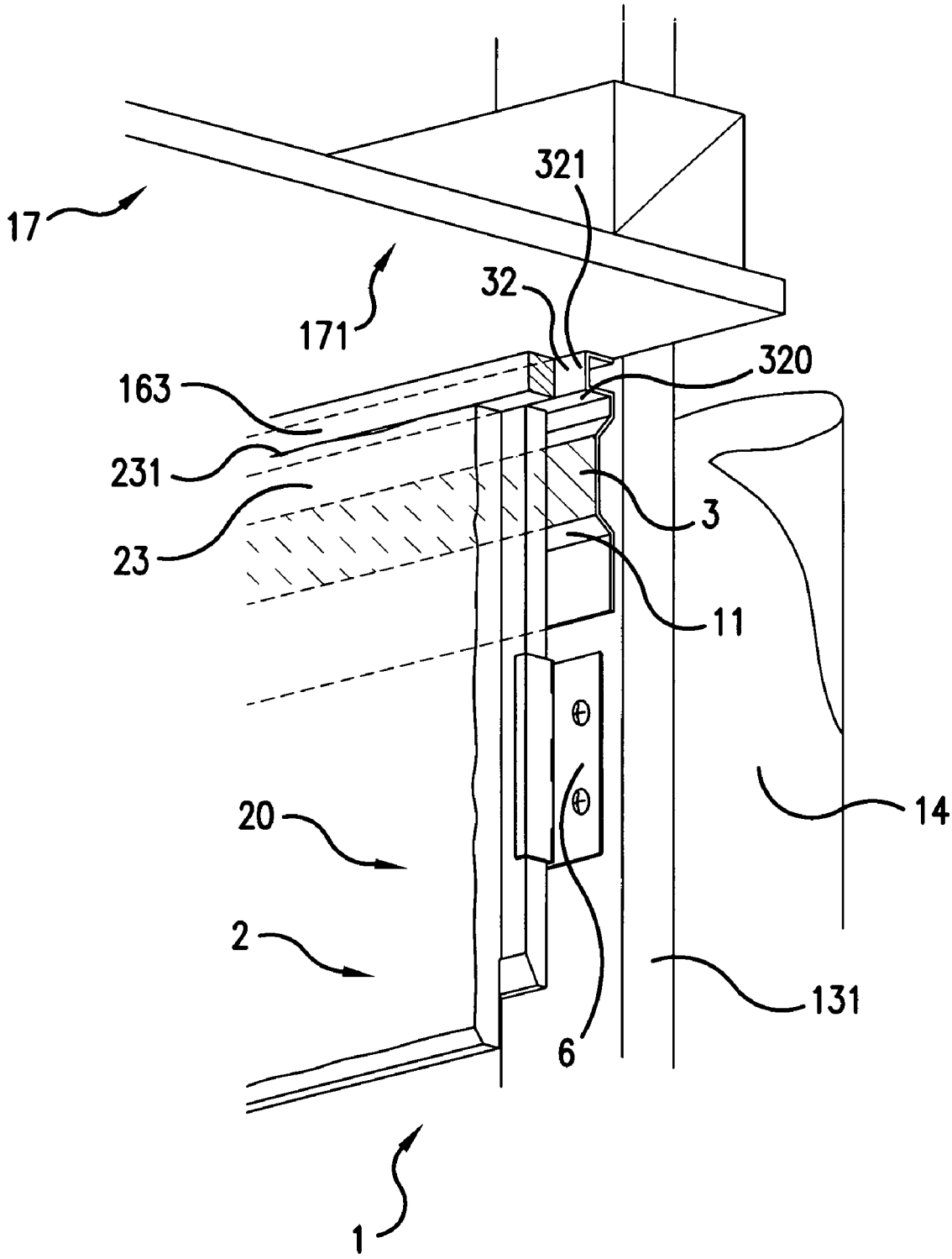
FIG. 7 is a perspective view showing an external wall constructing structure of example 3 of the invention.

As shown in FIG. 7, this example shows an external wall constructing structure 1 applied to a position below an eaves top board 171. A cut-off end portion 23 of a dimension-adjusted external wall panel 20 is placed under the eaves top board 171 and an end constructing bracket 3 is engaged to the cut-off end portion 23.

Below the eaves top board 171, a vertical furring strip 131 and the dimension-adjusted external wall panel 20 are arranged. The dimension-adjusted external wall panel 20 is cut off in the upper portion so as to fit the shape of the eaves top board 171 under which the cut-off end portion 23 is located with having the end constructing bracket 3 thereon.

The end constructing bracket 3 is arranged so that a forward-bending portion 32 is located at the uppermost position. A horizontal section 320 of the forward-bending portion 32 is abutted on a cut-off end surface 231 of the dimension-adjusted external wall panel 20. In other words, the end constructing bracket 3 is arranged upside down compared to example 1. A sealing material 163 is disposed between the cut-off end portion 23 and the eaves top board 171. A front section 321 of a forward-bending portion 32 of the end constructing bracket 3 is located on the rear side of the sealing material 163. The example 3 is the same as example 1 except for the conditions described above.

Example 4

This example shows an external wall constructing structure 1 with a tie-in part at a ridge side of a lower roof (not shown in the figure). An end constructing bracket 3 is engaged to a cut-off end portion 23 of a dimension-adjusted external wall panel 20 disposed at the tie-in part. A front moisture permeable waterproof sheet 14, a sheet of flashing and a rear waterproof sheet are placed between the furring strip 13 and the skeleton 10. A sealing material 163 is disposed between the cut-off end portion 23 and the sheet of flashing. A front section 321 of a forward-bending portion 32 of the end constructing bracket 3 is located on the rear side of the sealing material 163. The example 4 is the same as example 1 except for the conditions described above.

Example 5

This example shows an external wall constructing structure 1 with a tie-in part at a flow side of a lower roof (not shown in the figure). A cut-off end portion 23 of a dimension-adjusted external wall panel 20 is a slope in the horizontal direction. The end constructing bracket 3 is arranged so as to fit the sloping cut-off end portion 23. Consequently the end constructing bracket 3 is also a slope against a skeleton 10. The example 5 is the same as example 1 except for the conditions described above.

Example 6

This example shows an external wall constructing structure 1 with an overhang part (a hanging wall part) (not shown in the figure). The end constructing bracket 3 is engaged to a cut-off end portion 23 of a dimension-adjusted external wall panel 20 arranged to fit the overhang part.

An eaves top board 171 is arranged for the overhang part. An overhang water drip is arranged at the front end portion of the eaves top board 171. A vertical furring strip 131 and the dimension-adjusted external wall panel 20 are arranged above the overhang water drip. The end constructing bracket 3 is engaged to the cut-off end portion 23 of the dimension-adjusted external wall panel 20. A sealing material 163 is disposed between the cut-off end portion 23 and the overhang water drip. A front section 321 of a forward-bending portion 32 of the end constructing bracket 3 is located on the rear side of the sealing material 163. The example 6 is the same as example 1 except for the conditions described above.

In addition to the above mentioned examples, the present invention can be applied for any other parts of building where the dimension-adjusted external wall panel 20 with the cut-off end portion 23 are arranged.

Figure 8A:
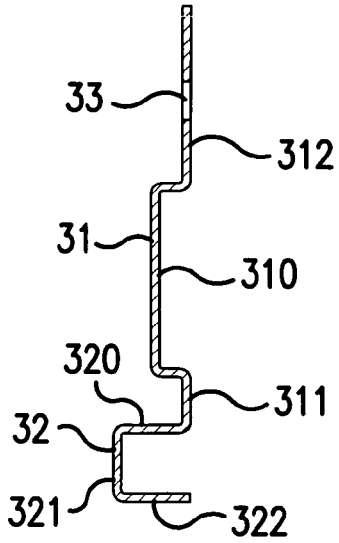
FIGS. 8A-8F are cross-sectional views of each of modified examples of an end constructing bracket shown in FIGS. 4A-4C.
Figure 8B:
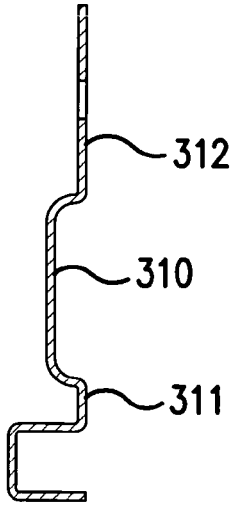
Figure 8C:
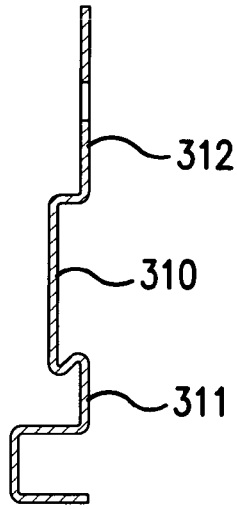
Figure 8D:
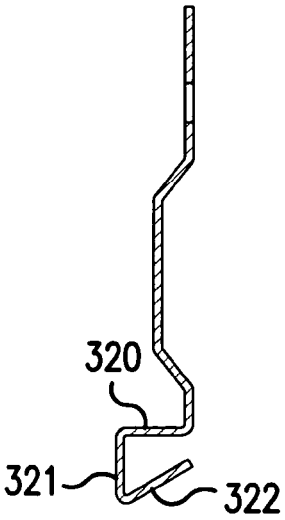
Figure 8E:
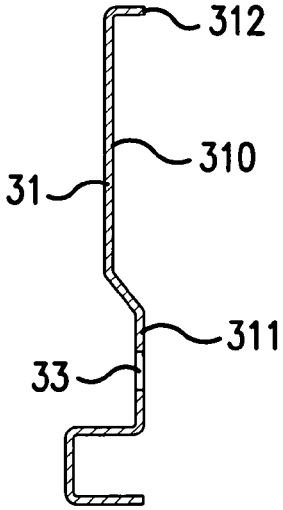
Figure 8F:
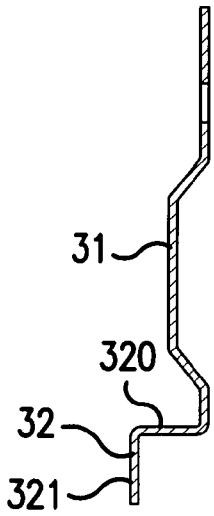
Figure 9:
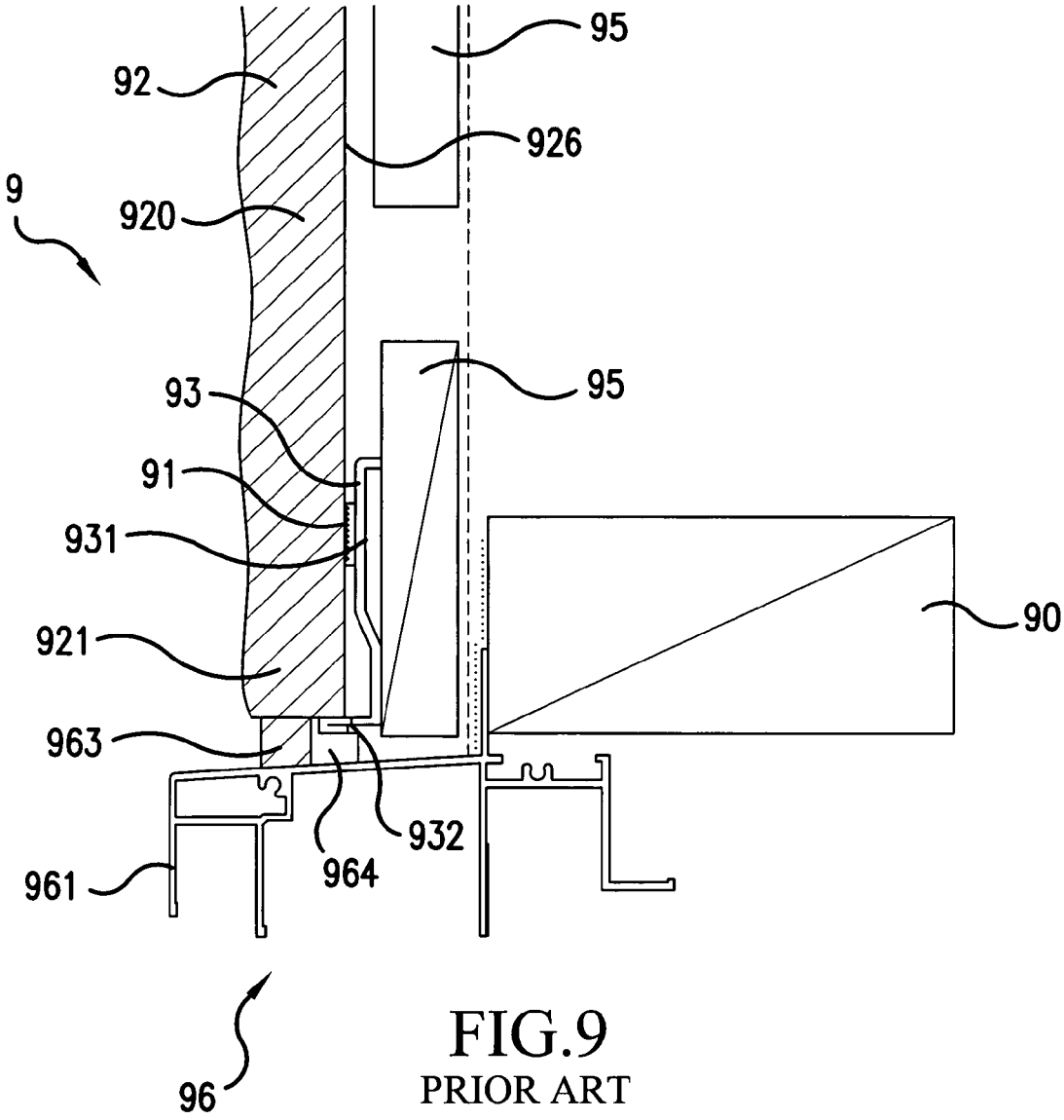
FIG.9 PRIOR ART
FIG. 9 is a perspective view showing an external wall constructing structure known in the prior art.

FIGS. 8A, 8B, 8C, 8D, 8E and 8F show modified examples of the end constructing bracket 3 used in the present invention. In particular FIG. 8F shows a shape of an end constructing bracket 3 without a third abutting section 322, which enables to reduce the cost of raw material and working up.

With respect to a skeleton of an external wall constructing structure of the present invention, a wooden construction is mainly taken as an example in the above description. The invention, of course, can be applied to other structure such as steel skeleton construction or reinforced concrete construction. An external wall constructing structure of the present invention is also applicable to masonry construction such as stone-built or concrete block construction, ALC (autoclaved lightweight concrete) block construction, or wall surface of ceramic type siding or ALC panel. The invention is of course applicable to both internal wall and external wall surface.

With respect to an external wall panel, a ceramic type siding is taken as an example in the above description. The invention, of course, can be applied to any other wall material, as long as it is a plate-like material capable of holding against an external force of earthquake or typhoon, such as metal siding, complex metal siding, extrusion cement board, calcined board (clay plate, ceramic board), or silica calcium board. Also a ceramic type siding or a metal siding with having a clay tile or a stone thereon by adhesion or bonding can be used.

A securing metal fitting and a lateral end securing metal fitting are preferably made by bending a metal plate such as such as iron plate, hot dip galvanized steel plate or stainless steel plate. The thickness of the plate of a securing metal fitting should be enough to avoid deformation or breakdown when receiving an external force. In the case of metal plate such as iron plate, the thickness is preferably 1.0 mm or more.

As an adhesive, an elastic adhesive such as modified silicone type, epoxy type, acrylic type or urethane type is preferable.

As a material for a furring strip, wood material, metal material and resin material can be used. Although any solid material with sufficient strength and not easily deformed by wind pressure can be used, wood material and metal material are preferable. The cross section shape of a furring strip is for example rectangular as shown in examples. However, any other shape can be used as long as it has enough strength and is not easily deformed. When a wood material is used as the furring strip, a rectangular cross section is preferable. When a metal material is used as the furring strip, a C-shaped or roughly hat-shaped cross section is preferable since a lightweight furring strip can be easily obtained.

The invention has been described in terms of preferred embodiment thereof, but is more broadly applicable as will be understood by those skilled in the art. The scope of the invention is only limited by the scope of the following claims and equivalents thereof.

What is claimed is:

1. An external wall constructing structure comprising a plurality of external wall panels that are joined to each other by vertical and horizontal shiplap joints and secured to a skeleton of a building by a securing metal fitting, wherein the plurality of external wall panels include a dimension-adjusted external wall panel having a cut-off end portion formed to adjust a vertical width of the panel, the dimension-adjusted external wall panel is fixed to the skeleton of the building by an end constructing bracket engaged to the cut-off end portion, and by a lateral end securing metal fitting engaged to one of a left or right joint end portion of the dimension-adjusted external wall panel, the end constructing bracket comprises a rear plate portion fixed to the skeleton and a forward-bending portion extending forward from one end of the rear plate portion, the rear plate portion of the end constructing bracket comprises a first abutting section that abuts the skeleton in one end area of the end constructing bracket that is adjacent to the forward-bending portion, a second abutting section that abuts the skeleton in another end area of the end constructing bracket, and a panel-rear-surface abutting section raised forward between the first abutting section and the second abutting section of the end constructing bracket that abuts the rear surface of the dimension-adjusted external wall panel, and the forward-bending portion of the end constructing bracket comprises a horizontal section that abuts a cut-off end surface of the dimension-adjusted external wall panel, and a front section downwardly extending from one end of the horizontal section.

2. The external wall constructing structure according to claim 1, wherein the forward-bending portion of the end constructing bracket further comprises a third abutting section further extending horizontally and backwardly from one end of the front section of the end constructing bracket to thereby abut the skeleton.

3. The external wall constructing structure according to claim 1, wherein the lateral end securing metal fitting comprises:

a base plate section with a screw hole for fixing the metal fitting to the skeleton, a bottom section bending upward from the base plate section so as to be perpendicular to the base plate section, a folding back section bending backward from the bottom section in a direction that is roughly parallel to the base plate section, a receiving section formed by bending an end part of the folding back section upward in a direction that is roughly perpendicular to the base plate section, a holding section formed by bending an end part of the receiving section forward in a direction that is roughly parallel to the base plate section, and a rear-surface abutting section that is formed by cutting and bending upward a part from the bottom section to the folding back section, so that a surface of the rear-surface abutting section is roughly parallel to the base plate section and abuts a rear surface of the dimension-adjusted external wall panel; and wherein the holding section holds the dimension-adjusted external wall panel at either a left or a right joint portion of the dimension-adjusted external wall panel, and a surface of the rear-surface abutting section abuts the rear surface of the dimension-adjusted external wall panel.

4. The external wall constructing structure according to claim 1, further comprising a sealing material placed in front of a front section of the forward-bending portion of the end constructing bracket.

5. The external wall constructing structure according to claim 1, wherein the external wall panel is a ceramic type external wall panel made of calcined base material.

* * * * *